United States Patent [19]

Cauley

[11] 4,094,430

[45] June 13, 1978

[54] CARGO CONTAINER

[76] Inventor: John F. Cauley, 847 Montgomery Drive, Ancaster, Ontario, Canada

[21] Appl. No.: 748,918

[22] Filed: Dec. 9, 1976

Related U.S. Application Data

[63] Continuation-in-part of Ser. No. 570,949, Apr. 22, 1975, abandoned.

[30] Foreign Application Priority Data

Jul. 15, 1974 Canada ..... 204749

[51] Int. Cl.[2] ..... B65D 87/00; B65D 7/44; E04C 1/10

[52] U.S. Cl. ..... 220/1.5; 52/588; 220/4 R; 220/71; 220/76; 296/30

[58] Field of Search ..... 220/1.5, 71, 73, 83, 220/75, 76, 4 R; 52/588, 529, 536, 45–53; 296/28 M, 29, 30

[56] References Cited

U.S. PATENT DOCUMENTS

| | | | |
|---|---|---|---|
| 2,144,945 | 1/1939 | Sutton | 220/71 |
| 2,384,965 | 9/1945 | Reid | 296/29 |
| 2,684,174 | 7/1954 | Schmitz | 220/71 |
| 2,833,588 | 5/1958 | Black | 296/28 M |
| 2,910,150 | 10/1959 | Roseman | 52/588 |
| 3,001,662 | 9/1961 | Herpich | 220/1.5 |
| 3,097,877 | 7/1963 | Erlandsen | 298/28 M |
| 3,188,131 | 6/1965 | Attwood | 296/29 |

*Primary Examiner*—William Price
*Assistant Examiner*—Allan N. Shoap
*Attorney, Agent, or Firm*—Cushman, Darby & Cushman

[57] ABSTRACT

A cargo container having an improved connection between the top and side walls comprising at least one grooved metal sheet connected to and extending from each said side wall and curving to extend at least partially across the top of the container, said grooved sheet extending transverse of the longitudinal axis of the container; each sheet having a raised lip seam longitudinally and continuously formed with the length of the sheet; and a curved metal edge strip extending longitudinally of the container; said edge strip being secured to the top surface of the grooved sheet to provide a box section with the trough part of the grooved sheet to thereby strengthen the groove sheet both longitudinally with the length of the container and transverse to the width thereof.

2 Claims, 6 Drawing Figures

CARGO CONTAINER

Figure 1:
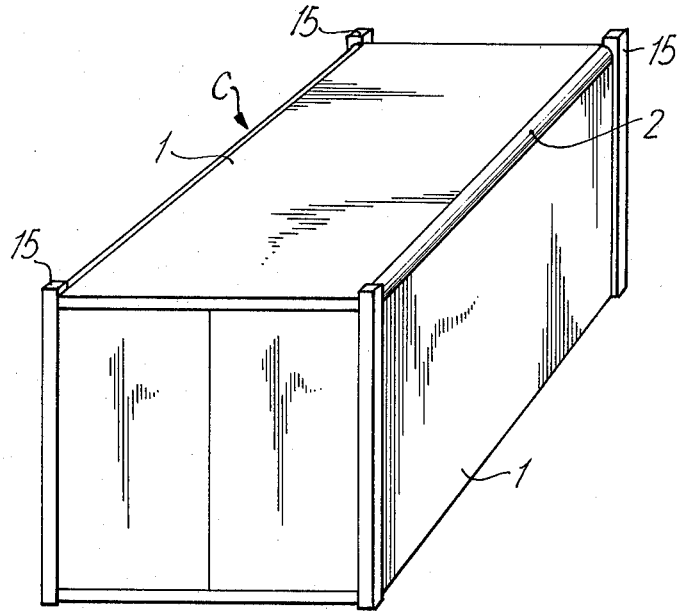

This application is a continuation in part application Ser. No. 570,949 filed Apr. 22, 1975, now abandoned.

This invention relates to cargo containers and in particular to an improved structural design for cargo containers used for the shipment of goods.

It has been found that during shipment of a loaded container repeated stress reversals occur at the longitudinal edge joints between the top and side walls throughout the length of the container, by reason of the sway of the transport vehicle. These stresses concentrate naturally by reason of the angular configuration or square shape at the longitudinal edge or corner joints of the container. The constant stress reversals eventually crack welded seams along the edge joints thereby exposing the shell to rain water leaks. This condition occurs most frequently with meat cargo or refrigerated containers due to the heavy loads of the meat hanging from the roof. Seam or edge cracking however will occur with any type of bulk cargo contained where welded edges or seams are transverse to the direction of the reciprocating stresses.

It is therefore a feature of the present invention to avoid the use of sheet metal joints at the corners transverse to the direction of stress across the width of the container roof thereby to provide a leak-proof joint between the panels of cargo container walls. This is provided by a raised lip seam running transverse of at least part of the top wall of the container and partway at least down the adjacent side walls.

It is another feature of the invention to provide a means for more even distribution of metal stresses at the longitudinal edge or seam between the roof and wall panel areas by means of structural grooves formed with a smooth radius of curvature joining the wall panel to the roof panel.

There is also provided a raised lip joint continuously along the longitudinal edges of the grooved metal sheets. Further in accordance with this invention there is provided a corner radius in the said metal sheets, which, in combination with the metal groove configuration, provide a means for equitable stress distribution in the shell at the corner area around the corner arch.

There is also provided a means for strengthening the grooves at the corners and therefore strengthening the walls and roof, laterally, and the walls and roof longitudinally by means of a shaped metal strip attached to the tops of the said groove configuration acting structurally in concert with the troughs of the grooves, the metal strip not impeding the free flow of water in the troughs of the grooves underneath the strip.

In accordance with one broad aspect of the invention, in a cargo container having a bottom, end and side walls and a top wall connected to said side and end walls, an improved connection between said side walls and the top wall comprising at least one grooved metal sheet connected to and extending from each said side wall and curving to extend at least partially across the top of the container, said grooved sheet extending transverse of the longitudinal axis of the container; each sheet having a raised lip seam longitudinally and continuously formed with the length of the sheet; and a curved metal edge strip extending longitudinally of the container; said edge strip being secured to the top surfaces of the grooved sheet to provide a box section with the trough part of the grooved sheet to thereby strengthen the groove sheet both longitudinally with the length of the container and transverse to the width thereof.

Figure 2:
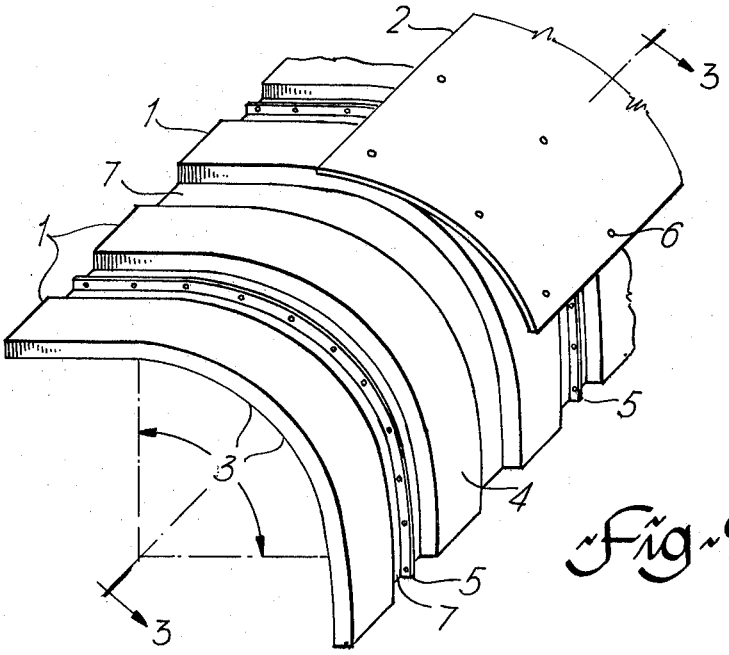
Figure 4:
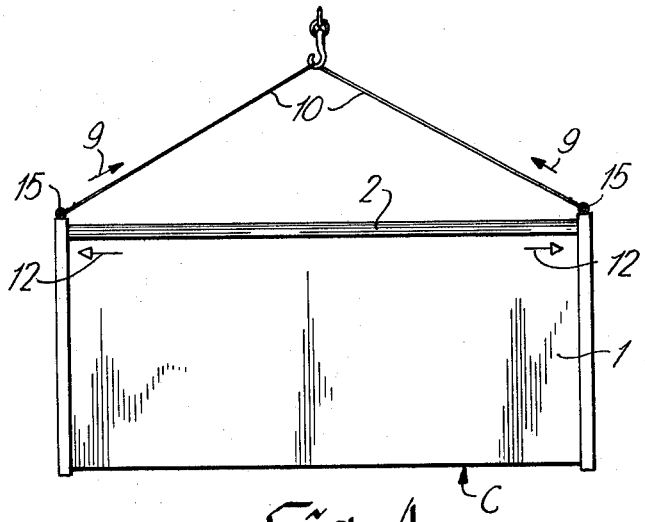
Figure 5:
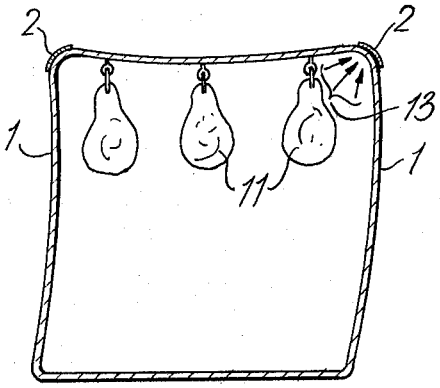
Figure 6:
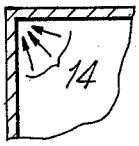
Figure 3:
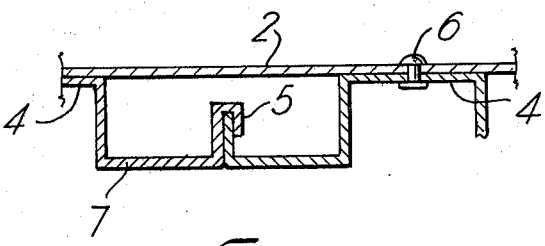

The invention is illustrated by way of example, in the accompanying drawings in which:

FIG. 1 illustrates a general view of the container, showing the grooved metal wall and roof sheets and the longitudinal corner reinforcing strip, FIG. 2 shows an enlarged view of the roof-to-wall corner, FIG. 3 is a cross-section taken on the line 3—3 of FIG. 2, FIG. 4 shows a container being raised by slings, FIG. 5 shows a cross-section schematic of the two walls and roof distorted during transit, and FIG. 6 illustrates a sharp corner as opposed to the long radius corner, the latter described as part of this invention.

The plastic redistribution of stress in beams, joints and frames is so important that it has become the principal basis for modern structural steel engineering design and the design of joints, connections and welds are generally made to take advantage of this principle. The invention incorporates a unique method of employment not yet applied to container design.

In accordance with the present invention there is provided a means for increasing the strength of the ceiling to wall corner of containers, the most important area of a frame bent to be reinforced without added attachments requiring cross welds. The container wall incorporates its own essential reinforcement grooves without added attachments. The curved metal attachment has been shown as an additional means of reinforcing the corner but, more importantly, as a longitudinal reinforcement of the box structure of the container when the box is lifted at the corner post by a crane.

For example, bridge structures have failed where welded attachments are made across the stress direction of tension members such as at the ends of cover plates on bridge girders. Unless carefully located in low stress areas, such welds can weaken the structural properties of the steel by as much as 50 to 60% of its original strength. The risk of metal failure for cross welded tension members is the same for either a bridge girder or cargo box corner. Only the thickness of metal is different. This risk is serious where the tension member is subject to oscillating load as at the roof to wall corner of a container.

The curved slope of the corner combined with the total absence of cross welds a) avoids the notch effect of the weld; b) the weakening of the work-hardened metal by the weld and c) provides a means for some stress distribution for the corner movement. The cargo container is a rectangular box which is subjected to both horizontal and vertical loads. The shape of the box and the combination of loads closely parallel a small frame building with a snow or ice-covered roof with a variable wind blowing.

With reference to FIGS. 1, 2 and 4, the grooved metal sheets can be observed forming the wall-to-roof corner section of a cargo container C in one continuous metal sheet 1, and joined to an adjacent similar sheet 1 by means of a raised metal lip joint 5 located in a groove trough 7, also continuously formed. There is also shown the longitudinal, shaped reinforcing strip 2 which is attached to the top of the formed sheet peaks 4, so as to bridge the troughs 7 between the said peaks 4, thereby providing a combined lateral and longitudinal reinforcement of the container shell C. The curved box sections formed by the attachment of the grooved sheet 1 to the longitudinal reinforcing strip 2 by spot welds or fasteners 6 provides an especially strong reinforcement of the corner area ideally suitable for distributing reciprocating stresses in the metal shell over a long corner radius surface 7 and thus preventing work hardening of the metal and cracking. FIG. 2 illustrates in particular the rounded corner 3 of the grooved sheet 1 and stand up or lip seam 5 around the corner area.

FIG. 3 shows a fragmentary cross-section of the apex of the corner marked as in FIG. 2. The cross-section shows the groove troughs 3 and tops of the groove 4 connected to the longitudinal corner reinforcing strip 2 by fasteners or spot welds 6.

FIG. 4 shows the engineering principle of the compressive forces in the curved longitudinal strip 2 resisting tensile forces applied in the directions 9 and 12 by cable or rope slings attached to the four top corners 15 of the container.

Fig. 5 is a schematic cross section of the two side walls and roof of the container being distorted (in exaggeration) by a suspended roof load such as meat carcasses 11 during transit of the container.

FIG. 6 shows a known sharp corner construction in which the stresses 14 are concentrated. In the present invention, plastic redistribution or dispersion of stress 13 (FIG. 5) is accomplished by the long radius corner 3.

I claim:

1. In a cargo container having a bottom, end, and side walls, and a top wall or roof, connected to said side and end walls, an improved connection between said side walls and the top wall comprising a plurality of continuous grooved metal sheets connected to and extending from each said side wall and curving to extend across the top of the container and defining a smooth, long radius corner, said grooved sheets extending transversely of the longitudinal axis of the container;

each sheet having at least one flat trough part and a parallel, adjacent flat top part joined to said trough part by flat side walls extending ninety degrees to said trough part and top parts, and a raised lip seam longitudinally and continuously formed with the length of the sheet;

each sheet being joined to an adjacent sheet by said lip seam;

in combination with a curved metal reinforcing edge strip contoured in cooperation with said long radious corner and extending parallel to said longitudinal axis along the upper corner between the side and top walls of the container; said edge strip overlying and being secured to the flat top parts of the grooved sheets defining a box section with the trough parts of the grooved sheets to thereby strengthen the grooved sheets both longitudinally with the length of the container and laterally about said radious corner in a direction transverse to said axis of said container.

2. A container according to claim 1, wherein the said grooved sheet is continuous in length across the roof around both roof to wall edges and down at least part of both opposing sides.

* * * * *